US009697997B2

(12) United States Patent
Chingin et al.

(10) Patent No.: US 9,697,997 B2
(45) Date of Patent: Jul. 4, 2017

(54) ION FRAGMENTATION

(71) Applicants: Konstantin Chingin, Stockholm (SE); Roman Zubarev, Stockholm (SE)

(72) Inventors: Konstantin Chingin, Stockholm (SE); Roman Zubarev, Stockholm (SE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 13/840,739

(22) Filed: Mar. 15, 2013

(65) Prior Publication Data

US 2014/0224983 A1 Aug. 14, 2014

(30) Foreign Application Priority Data

Feb. 14, 2013 (GB) ..... 1302586.1

(51) Int. Cl.
*H01J 49/00* (2006.01)
*H01J 49/14* (2006.01)

(52) U.S. Cl.
CPC ..... *H01J 49/0072* (2013.01); *H01J 49/0031* (2013.01); *H01J 49/0095* (2013.01); *H01J 49/14* (2013.01); *H01J 49/005* (2013.01)

(58) Field of Classification Search
None
See application file for complete search history.

(56) References Cited

U.S. PATENT DOCUMENTS 3,258,591 A * 6/1966 Blauth ..... H01J 49/027 250/286
4,650,630 A * 3/1987 Boyer ..... G21B 1/15 376/107
5,073,713 A * 12/1991 Smith ..... H01J 49/004 250/282
5,734,161 A * 3/1998 Koster ..... 250/287
6,800,851 B1 10/2004 Zubarev et al.
6,995,366 B2 2/2006 Franzen
7,145,139 B2 12/2006 Syka
7,449,687 B2 11/2008 Li
7,759,637 B2 7/2010 Thomson
(Continued)

FOREIGN PATENT DOCUMENTS

GB 2 405 526 A 3/2005
GB 2429836 A 3/2007
(Continued)

OTHER PUBLICATIONS

Vestal, "Methods of Ion Generation", Che,. Rev. 2001, 101, 361-375.*

(Continued)

*Primary Examiner* — Wyatt Stoffa
*Assistant Examiner* — James Choi
(74) *Attorney, Agent, or Firm* — David A. Schell; Charles B. Katz

(57) ABSTRACT

A collision cell for a mass spectrometer arranged to receive ions for fragmentation in a chamber and comprising an activation ion generator configured to irradiate the received ions with activation ions of the same polarity as the received ions. The activation ion generator is preferably a plasma generator, configured to generate a plasma comprising the activation ions.

42 Claims, 7 Drawing Sheets

(56) References Cited

U.S. PATENT DOCUMENTS

| | | | | |
|---|---|---|---|---|
| 8,410,437 | B2 * | 4/2013 | Brown | H01J 49/065 250/281 |
| 2004/0173740 | A1 * | 9/2004 | McLuckey | H01J 49/0063 250/288 |
| 2005/0218816 | A1 * | 10/2005 | Tantraporn | H01J 49/105 315/111.81 |
| 2005/0258353 | A1 | 11/2005 | Berkout et al. | |
| 2006/0075739 | A1 * | 4/2006 | Wiseman | 60/202 |
| 2006/0192100 | A1 | 8/2006 | Zubarev et al. | |
| 2007/0138383 | A1 * | 6/2007 | Dowell | H01J 49/0072 250/281 |
| 2008/0128611 | A1 * | 6/2008 | McLuckey et al. | 250/283 |
| 2009/0250605 | A1 * | 10/2009 | Scigocki | 250/282 |
| 2009/0283672 | A1 * | 11/2009 | Brekenfeld et al. | 250/282 |
| 2011/0084205 | A1 * | 4/2011 | Makarov et al. | 250/282 |
| 2011/0155901 | A1 * | 6/2011 | Vestal | H01J 49/0072 250/282 |
| 2011/0186749 | A1 * | 8/2011 | Godet et al. | 250/424 |
| 2013/0221233 | A1 * | 8/2013 | Whitehouse | H01J 49/147 250/396 R |

FOREIGN PATENT DOCUMENTS

| | | | |
|---|---|---|---|
| GB | 2459953 | A | 11/2009 |
| WO | WO 2010/002819 | A1 | 1/2010 |

OTHER PUBLICATIONS

Syka et al., "Peptide and protein sequence analysis by electron transfer dissociation mass spectrometry," PNAS (2004), vol. 10, No. 26, pp. 9528-9533.

Baba et al., "Electron Capture Dissociation in a Radio Frequency Ion Trap," Anal. Chem. 2004, 76, pp. 4263-4266.

Li Ding et al., "Electron Capture Dissociation in a Digital Ion Trap Mass Spectrometer," Anal. Chem. 2006, 78, pp. 1995-2000.

Vadym D. Berkout, "Fragmentation of Protonated Peptide Ions via Interaction with Metastable Atoms," Anal. Chem, 2006, 78, pp. 3055-3061.

Williams et al., "Dual Electrospray Ion Source for Electron-Transfer Dissociation on a Hybrid Linear Ion Trap-Orbitrap Mass Spectrometer," Anal. Chem. 2007, 79, pp. 7916-7919.

Kaplan et al., "Electron transfer dissociation in the hexapole collision cell of a hybrid quadrupole-hexapole Fourier transform ion cyclotron resonance mass spectrometer," Rapid Commun. Mass Spectrom. 2008, 22, pp. 271-278.

Voinov et al., "Electron Capture, Collision-Induced, and Electron Capture-Collision Induced Dissociation in Q-TOF," J. Am. Soc. Mass Spectrom. (2011) 22, pp. 607-611.

* cited by examiner

ION FRAGMENTATION

TECHNICAL FIELD OF THE INVENTION

The invention concerns a collision cell, a mass spectrometer comprising such a collision cell and a method of ion fragmentation.

BACKGROUND TO THE INVENTION

Mass spectrometry (MS) has become a central tool in many fields of bioanalytical science, such as proteomics and metabolomics. The power of MS is steadily increasing with regard to sensitivity, mass accuracy, resolving power and precision of detection. With modern instruments, biological samples can be analyzed in a broad dynamic range (around 4 orders of magnitude) and mass-to-charge ratio (m/z) range (around 200 to 4,000) with high resolution (>100,000) and acquisition rates (>10 Hz). A limiting factor for direct mass analysis is the sequencing capability of MS. The specificity and the accuracy of analyte identification often suffer from the insufficient capacity of mass spectrometers to generate informative fragmentation pattern characteristics for the precursor ions. The efficiency of tandem MS (MS/MS) is particularly limited for large proteins. This is a major reason preventing wider application of top-down approaches, especially to protein-molecule complexes obtained by "native" MS.

The most commonly used method of fragmentation is referred to as Collision-Activated or Collision-Induced Dissociation (CAD/CID). In CAD/CID, accelerated precursor ions undergo multiple collisions with neutral gas molecules, resulting in gradual vibrational heating followed by the ultimate dissociation of the weakest bonds. Polypeptide precursor ions preferentially dissociate across backbone C—N bonds, yielding 'b' (N-terminal) and 'y' (C-terminal) fragments, respectively. An advantage of CAD is the relatively short time needed to generate abundant fragmentation (in the order of milliseconds) and easy technical implementation. One of the key limitations of CAD relevant to biological analyses is its poor sensitivity to the presence of Post-Translational Modifications (PTMs). Small PTMs, such as phosphorylation or sulfation functional groups, are often weakly bound to the polypeptide backbone and tend to be easily lost during activation, which prevents their observation in tandem MS. Besides that, the efficiency of sequencing based on CAD MS/MS commonly suffers from incomplete fragmentation along the peptide backbone. Finally, CAD is rather inefficient for large proteins because the energy supplied during the activation dissipates across the large number of vibrational modes. As a result, only a few peptide bonds fragment: those that receive vibrational heating sufficient for their dissociation.

Distinct from CAD/CID are Electron Capture/Transfer Dissociation (ECD/ETD) techniques, in which precursor ions receive an electron. Such techniques are described in U.S. Pat. No. 7,145,139 and U.S. Pat. No. 6,995,366. Electron addition to closed-shell molecular cations converts them to unstable radical cations of the "hydrogen-abundant" type. In addition, 4-7 eV of recombination energy is deposited, which adds a degree of vibrational heating. Electron transfer to multiply protonated polypeptides preferentially induces fast, perhaps even nonergodic, cleavage of N—Cα backbone bonds, yielding 'c' (N-terminal) and 'z' (C-terminal) types of fragments. In many cases, the high speed of the primary ECD process prevents significant redistribution of the recombination energy among vibrational modes prior to dissociation. As a result, loosely bound functional groups, such as found in protein-molecule complexes and in proteins with labile PTMs, can "survive" dissociation and be localized in the generated c and z fragments.

The sequence preferences in ETD/ECD and CAD/CID are complementary and the combination of their MS/MS data greatly facilitates spectral interpretation and reduces the rate of misidentifications in proteomics analyses. In high-resolution Fourier transform mass spectrometry (FTMS), the combined use of ECD and CAD has been demonstrated to improve the validity of the database search data by 20 to 100 times and to result in substantially higher number of identified proteins compared to CAD-only analysis. The cross-section of electron capture rapidly increases with the ionic state of precursor polypeptides, making it particularly suitable for the fragmentation of highly protonated species. For instance, electron capture cross section of cytochrome c+15 ions measured at typical ECD conditions exceeded the ion-neutral collision cross section by two orders of magnitude.

Alongside with ECD and ETD, a number of tandem MS techniques have been introduced that employ electron activation. In Electron Detachment Dissociation (EDD), deprotonated polypeptides are charge-reduced through the collisions with free electrons. This is described in Budnik, B. A.; Haselmann, K. F.; Zubarev, R. A. *Chem. Phys. Lett.* 2001, 342, 299. Reduced radical species dissociate along the Cα—C backbone giving rise to 'x' and 'a' fragments. In Metastable-Induced Dissociation (MIDI), electronically excited atoms of noble gas are used as electron donors to activate cationic polypeptides, resulting in fragmentation pattern similar to ECD/ETD. This is described in US-2005/258353 and Misharin, A. S.; Silivra, O. A.; Kjeldsen, F.; Zubarev, R. A. *Rapid Commun. Mass Sp.* 2005, 19, 2163, and Berkout, V. D., Anal. Chem. 2006, 78, 3055 for example. Alternatively, electron transfer to polypeptides can also be induced via high-energy collisions with alkali metal vapours.

The efficiency (determined as the ratio of the product ion abundances versus the precursor ion abundance) of ECD/ETD strongly depends on the charge state of precursor species. At low charge states, the efficiency of these techniques tends to be limited, especially for 2+ precursors, for which one of the fragments is by necessity neutral. The latter limitation may represent a serious problem for shotgun proteomics, in which the most of analyzed proteolytic peptides are doubly charged. Thus, increasing the charge state of precursor ions prior to fragmentation would enhance the efficiency of subsequent activation by electron transfer and enable the application of ECD/ETD to singly-charged precursors. Such a "supercharging" of analyte cations can be achieved via Electron Ionization Dissociation (EID) of trapped ions, such as described in GB-2 405 526, U.S. Pat. No. 6,800,851 and Fung, Y. M. E.; Adams, C. M.; Zubarev, R. A. *J. Am. Chem. Soc.* 2009, 131, 9977. However, the difficulty of dealing with electron beams entering a radiofrequency multipole may have prevented such a method from being widely applied.

An improved method of ion fragmentation is therefore desirable, especially one suited to MS/MS analysis of biological samples.

SUMMARY OF THE INVENTION

Against this background, there is provided a collision cell arranged to receive ions for fragmentation in a chamber and comprising an activation ion generator configured to irradiate the received ions with activation ions of the same polarity as the received ions.

Advantageously, the activation ion generator is a plasma generator, configured to generate a plasma comprising the activation ions, such that the activation ions are advantageously generated as a plasma. An activation ion beam (especially when generated as a plasma beam and/or particularly when accelerated), may contain a large variety of ionic, electronically excited (metastable) and neutral species within a broad range of kinetic energies. Some of these species may be non-reactive, but others react with the target precursors through a variety of collisional, proton-, atom- and electron transfer reactions. MS/MS analysis may reveal a plethora of reactions, including charge reduction and charge increase of analyte species, as well as polypeptide backbone cleavages along each of the inter-residue bond types (C—CO, C—N, N—Cα). The present invention may thereby provide a collision cell configured to fragment received ions by means of an ion beam so as to cause simultaneous observation of b/y and c/z fragments and charge increased precursor ions.

Preferably, the activation ion generator is configured to irradiate the received ions with a charged gas comprising the activation ions of the same polarity as the received ions. This may be formed from such gases as air, nitrogen, oxygen, hydrogen, methane, carbon monoxide and dioxide and inert gases (for instance He, Ne, Ar, etc.) as well as others. Mixtures of gases could be also used. Vapours of liquid or solid substances may also be used, preferably by heating them as well as a plasma chamber of the plasma generator in which charged gas may be formed, particularly as a plasma.

In the preferred embodiment, the activation ions are positively charged. Advantageously, the activation ions are at high energy when they irradiate the received ions, possibly between 700 eV and 1500 eV.

In an embodiment, the plasma generator comprises a plasma chamber, arranged to receive a gas. This gas may then be used to generate a plasma comprising the activation ions. Optionally, the plasma generator is arranged to receive the gas via a leak valve. Advantageously, the plasma generator further comprises a microwave energy generator configured to irradiate gas received in the plasma chamber and generate the plasma thereby. In the preferred embodiment, the plasma generator is an ion gun. Alternative sources to generate intense ion beams in a vacuum include duoplasmatron, laser plasma, chemical ionization, electron ionization or similar.

Beneficially, the collision cell further comprises an excitation field generator, arranged to excite the plasma generated within the plasma chamber. This may increase plasma density thereby. Preferably, the excitation field generator comprises a magnetic field generator. The excitation field generator is beneficially configured to impose the effect of a cyclotron resonance on the generated plasma.

In embodiments, the plasma generator further comprises extraction ion optics configured to transfer the activation ions (possibly together with other components of the plasma) from the plasma chamber towards the collision cell chamber. Preferably, the extraction ion optics comprises: a first grid electrode for receiving a first potential; a second grid electrode for receiving a second potential, spaced apart from the first grid electrode. Beneficially, the first and second potentials are of opposite polarity. The second potential is optionally greater in magnitude than the first potential. Advantageously, the extraction ion optics further comprises a power supply arrangement configured to provide the first and second potentials. In the preferred embodiment, the extraction ion optics is configured to transfer cations from the plasma chamber towards the collision cell chamber. The first potential may be between 100 V and 1000 V and the section potential may be between −600 V and −1400 V.

In some embodiments, the collision cell further comprises an interface between the activation ion generator and the collision cell chamber. Advantageously, the collision cell further comprises a pumping arrangement configured to provide a vacuum in the interface. For instance, the pressure in the interface may vary between $10^{-6}$ mbar ($10^{-4}$ Pa) and $10^{-4}$ mbar ($10^{-2}$ Pa).

In embodiments, the interface further comprises an ion optics lens, configured to facilitate transfer of the activation ions from the activation ion generator to the collision cell chamber. This ion optical lens may be provided in addition to the extraction ion optics discussed above. Preferably, the extraction ion optics is located in the activation ion generator and the ion optical lens is located in the interface. A potential may be applied to the ion optics lens. This potential may be greater in magnitude than the second potential applied to the extraction ion optics.

Advantageously, the collision cell further comprises trapping electrodes configured to provide a trapping field for confinement of the received ions to the chamber. Thus, the collision cell may act as a trap for capture and storage of precursor ions, which are then fragmented. The trapping electrodes are preferably configured to receive one or more DC potentials in order to generate the trapping field.

More preferably, the collision cell further comprises a controller, configured to control the DC potential applied to the trapping electrodes. The controller may be configured to control the DC potential such that: a first set of DC potentials is applied to the trapping electrodes during a first time period, in order to cause ions for fragmentation to enter the collision cell chamber; and a second set of DC potentials is applied to the trapping electrodes during a second time period, subsequent to the first time period, the first and second potentials having opposite polarities. This voltage inversion may cause the focusing of precursor ions closer to an aperture through which plasma is received into the collision cell chamber. The plasma beam density may be higher in this region.

The controller is optionally further configured to control the DC potential applied to the trapping electrodes such that a third set of DC potentials is applied to the trapping electrodes during a third time period, in order to cause fragmented ions to exit the collision cell chamber. Beneficially, the first set of DC potentials is set such that ions enter the collision cell chamber in a first direction and the third set of DC potentials is set such that ions exit the collision cell chamber in a second direction, opposite to the first direction.

The chamber preferably comprises an ion receiving aperture, configured to allow entrance of ions into the chamber for fragmentation. Advantageously, the ion receiving aperture is also configured to allow exit of fragment ions from the chamber.

In a second aspect, there is provided a mass spectrometer, comprising: an ion source for generating ions; a collision cell as described herein, arranged to receive generated ions and to fragment the received ions; and a mass analyser, configured to receive fragment ions for analysis. Beneficially, the mass analyser is configured to receive parent ions and fragment ions for analysis. In the preferred embodiment, the ion source is configured to generate ions by Electrospray Ionization (ESI). Optionally, the ion source is configured for generating ions from a polypeptide sample.

In a third aspect, there is provided a method of ion fragmentation, comprising: receiving ions for fragmentation in a collision cell chamber; and irradiating the received ions with activation ions of the same polarity as the received ions. Optionally, the step of irradiating comprises irradiating the received ions with a charged gas comprising the activation ions of the same polarity as the received ions. The activation ions are advantageously generated within a plasma, which may be a gas plasma. It will be understood that this method may comprise optional method steps corresponding with any one or more of the apparatus features defined herein. A number of these are now explicitly noted below.

Preferably, the step of irradiating comprises receiving a gas in a plasma chamber of a plasma generator. This may occur via a leak valve. Optionally, the step of irradiating further comprises generating a plasma comprising the activation ions by irradiating the gas received in the plasma chamber with microwave energy. In some embodiments, the step of irradiating further comprises exciting the plasma generated within the plasma chamber, in order to increase plasma density thereby. In embodiments, the step of exciting comprises imposing the effect of a cyclotron resonance on the generated plasma, advantageously using a magnetic field.

In the preferred embodiment, the step of irradiating further comprises transferring the activation ions from the plasma chamber towards the collision cell chamber using extraction ion optics. Preferably, the step of transferring comprises: providing a first potential to a first grid electrode of the extraction ion optics; providing a second potential to a second grid electrode of the extraction ion optics, spaced apart from the first grid electrode; and wherein the first and second potentials are of opposite polarity. In this way, the activation ions of the same polarity as the received ions (for example, cations) may be extracted.

Advantageously, the step of irradiating comprises: transferring the activation ions from an activation ion generator to the collision cell chamber via an interface; and optionally providing a vacuum in the interface. The step of irradiating may further comprise facilitating transfer of the activation ions from the activation ion generator to the collision cell chamber using an ion optics lens.

Beneficially, the method further comprises providing a trapping field for confinement of the received ions to the chamber. Then, the step of providing a trapping field may comprise applying one or more DC potentials to trapping electrodes. Optionally, the step of applying one or more DC potentials to the trapping electrodes comprises: applying a first set of DC potentials to the trapping electrodes during a first time period, in order to cause ions for fragmentation to enter the collision cell chamber; and applying a second set of DC potentials to the trapping electrodes during a second time period, subsequent to the first time period, the first and second potentials having opposite polarities.

In embodiments, the step of applying one or more DC potentials to the trapping electrodes further comprises applying a third set of DC potentials to the trapping electrodes during a third time period, in order to cause fragmented ions to exit the collision cell chamber. Advantageously, the first set of DC potentials is set such that ions enter the collision cell chamber in a first direction and wherein the third set of DC potentials is set such that ions exit the collision cell chamber in a second direction, opposite to the first direction.

In the preferred embodiment, the step of receiving ions for fragmentation further comprises receiving the ions into the collision cell chamber via an ion receiving aperture. Preferably, the method further comprises ejecting fragment ions from the collision cell via the ion receiving aperture.

The combination of any of the apparatus features described herein, the method features described herein or both is also provided even if not explicitly disclosed. A controller configured to carry out the method as described herein may also be provided.

BRIEF DESCRIPTION OF THE DRAWINGS

The invention may be put into practice in various ways, one of which will now be described by way of example only and with reference to the accompanying drawings in which.

DETAILED DESCRIPTION OF A PREFERRED EMBODIMENT

Figure 1A:
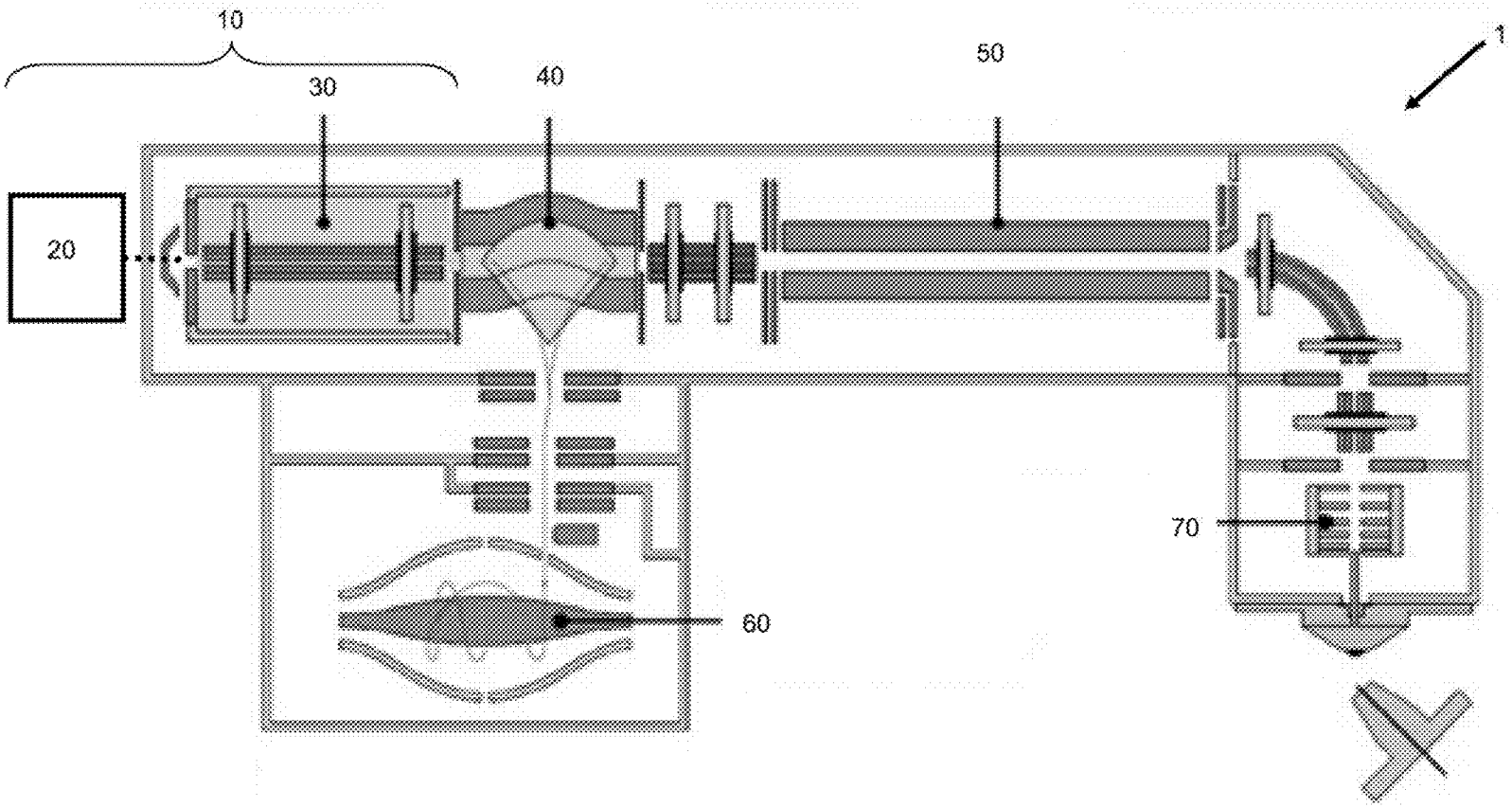
FIG. 1A shows a schematic diagram of a mass spectrometer comprising a collision cell in accordance with the present invention.

Referring first to FIG. 1A, there is shown a schematic diagram of a mass spectrometer comprising a collision cell 1 in accordance with the present invention. Although details regarding the specific mass spectrometer with which the collision cell 1 was used will be discussed below, it should be noted that the collision cell of the present invention may be used with a variety of different analytical instruments, especially in the field of mass spectrometry. The specific mass spectrometer configuration shown in FIG. 1A is therefore provided as an example only.

The mass spectrometer 1 comprises: a collision cell arrangement 10; an ion storage device 40; a mass filter 50; a mass analyser 60; and an ion source 70. The collision cell arrangement 10 comprises: a plasma generator 20; and a collision cell 30. The ion storage device 40 in this embodiment is a curved trap (C-trap), the mass filter 50 is a quadrupole device, the ion source 70 is an S-lens source and the mass analyser 60 is of orbital trapping type. All of these devices may be varied, as noted above. Additionally or alternatively, the configuration of the devices may be varied, in line with the comments above.

For the collision cell arrangement 10, the plasma generator 20 (which is specifically an ion gun) is mounted at the back of the collision cell 30 which is a High-energy Collision Dissociation (HCD) cell. Precursor ions are isolated by the selective quadrupole mass filter 50 and are trapped in the HCD cell 30. They are then exposed to plasma beam irradiation from the plasma generator 20 over a desired time interval. Ionic fragments that are generated are then transferred to the mass analyzer 60 for detection. The generation of fragment ions using the collision cell arrangement 10 is believed to be significantly different from existing collision cell designs.

In order to evaluate the collision cell arrangement 10, an experimental apparatus based on the mass spectrometer design in FIG. 1A was tested. This design corresponds with the bench-top Q Exactive™ mass spectrometer (made by Thermo Fisher Scientific, Bremen, Germany). More details about the experimental apparatus are now provided as an example. The experimental results will then be discussed to demonstrate the benefits of the collision cell arrangement 10.

Figure 1B:
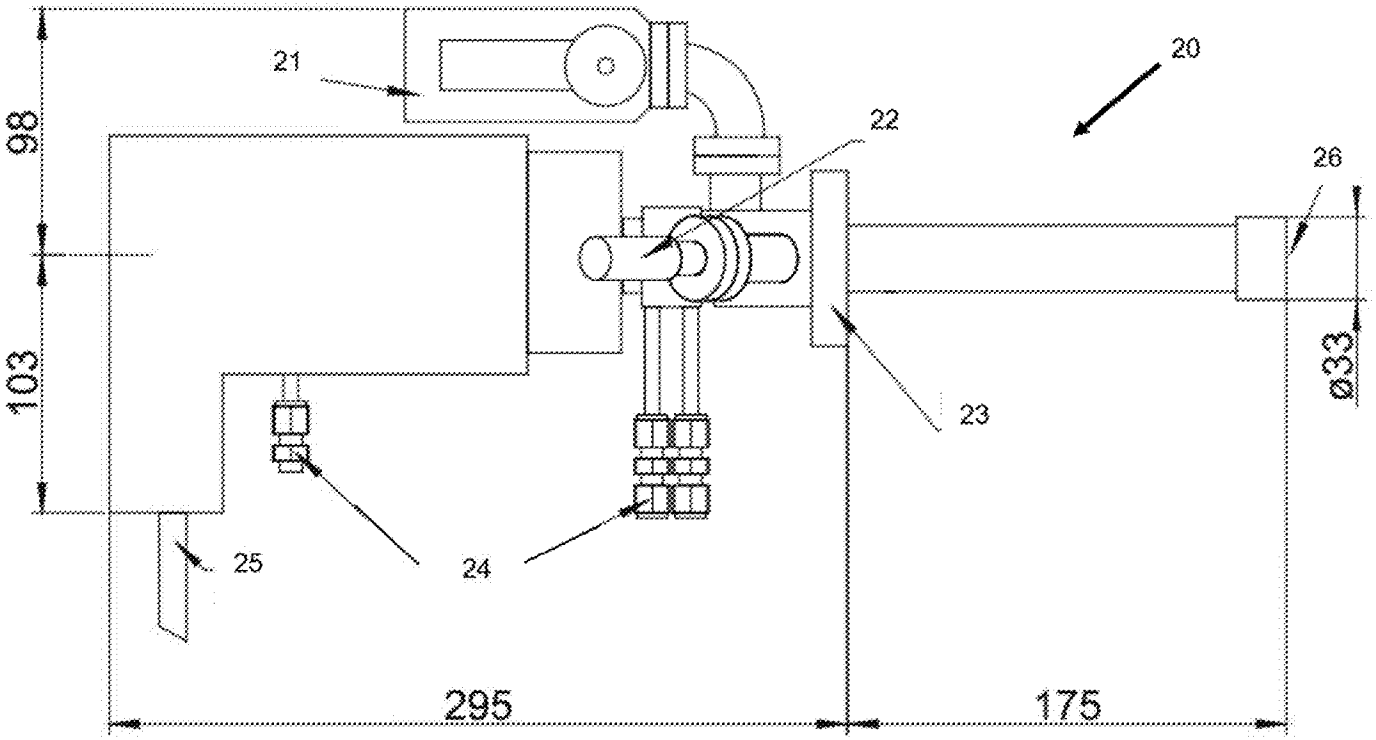
FIG. 1B illustrates a schematic diagram of a plasma generator for use in the collision cell of FIG. 1A.

The plasma generator 20 in the experimental apparatus is a filamentless IonEtch™ sputter gun (Tectra, Frankfurt, Germany) that utilizes a microwave plasma discharge. Referring to FIG. 1B, there is shown a schematic diagram of such a plasma generator. Measurements shown in this schematic are an example for illustration purposes only. The plasma generator comprises: a leak valve 21; electrical feedthrough 22; mounting flange 23; water cooling 24; power supply cable 25; and ion beam exit 26.

In this gun, microwave energy is pumped into an alumina chamber, and plasma is ignited in the gas introduced externally into the chamber via an optional leak valve. Plasma density is enhanced via the effect of cyclotron resonance caused by a quadrupole magnetic field around the chamber. Positive ions are extracted out of the chamber using two-grid extraction optics. The first lens (anode) is typically at a voltage in the range from 100 V to 1000 V, and the second lens (cathode) is at a voltage from −600 V to −1400 V. The magnetron current varies from 15 to 20 mA, and the beam current measured about 5 cm away from the cathode lens is in the range of 50-200 μA.

The sputter gun is mounted on the back flange of HCD cell 30 using a dedicated interface and evacuated by an additional turbo-pump to improve the background vacuum inside the plasma chamber. The pressure measured in close proximity to the gun is around $9\times10^{-6}$ mbar ($9\times10^{-4}$ Pa) when the gas leak valve is fully closed. The feed gas is supplied at the flow rate of about 1 to 5 sccm, which results in a pressure increase up to $5\times10^{-5}$ mbar ($5\times10^{-3}$ Pa) to $5\times10^{-4}$ mbar ($5\times10^{-2}$ Pa). The ion beam generated by the gun enters the interior of HCD cell via a 2.5 mm ID orifice in the back lens. The distance from the end of the gun to the HCD cell is approximately 2 cm. An additional ion lens (at a voltage of −2000 V) is installed between the cathode and the HCD back lens to facilitate ion beam extraction.

The goal of the experiments now described is to test the complex network of reaction pathways available in the experimental setup using commercially available instrumentation. The observed fragmentation patterns are compared to reference CAD and ETD MS/MS analyses, and relevance of the method for bioanalytical studies is discussed.

In specific tests, Angiotensin I (DRVYIHPFHL) and ubiquitin are used without further purification. Polypeptide molecules are dissolved in electrospray solvent (water-methanol-acetic acid 49:49:2 v:v:v) at a concentration of $10^{-5}$ M and are electrospray ionised using the standard MaxSpray set-up and a syringe pump.

Experiments were performed in the MS/MS mode of the Q Exactive™ instrument operation, with the plasma source being constantly switched on. Source installation and operation requires removal of the charge detector used for the ion current control in routine MS experiments. Therefore, automated gain control is unavailable in the specific experiments described. Precursor ions are injected inside the HCD cell with near zero kinetic energy to avoid fragmentation via collisions with buffer gas. Ion injection is followed by a 3 ms time delay, after which the axial DC voltage gradient along the HCD cell is inverted (from +20 V to −20 V). This voltage inversion allows focusing precursor ions closer to the gun exit, where the plasma beam density is higher. Trapped ions are irradiated for no longer than 5 seconds, after which the DC voltage gradient is changed back to normal, and the product ions are transferred to the C-trap 40. MS detection is done in the analyzer 60 using standard instrument settings.

In the tests described herein, ion peaks corresponding to the fragmentation of polypeptides are annotated in accordance with the conventional nomenclature. N- and C-terminal fragments are denoted as a and x if they are produced via the cleavage of C—CO backbone bond, b and y for C—N, and c and z for N—Cα cleavage, accordingly. Fragments generated via homolytic bond cleavage are marked with a dot (e.g., b. and y.). If intra-molecular transfer of hydrogen atom (H.) occurred during dissociation, a hydrogen-accepting fragment (+H.) is labelled with a prime sign (e.g., y') and a hydrogen-donating fragment (−H.) remains unlabeled (for example, b). Peak assignment is done using MS-Product utility of online ProteinProspector proteomics tool (http://prospector.ucsf.edu/prospector/cgi-bin/msform.cgi?form=msproduct). MS/MS pattern induced in-silico included both internal and terminal types of fragmentation (a, b, c, d, v, w, x, y, z) as well as $NH_3$ and $H_2O$ neutral losses with 20 ppm mass tolerance.

Figure 2A:
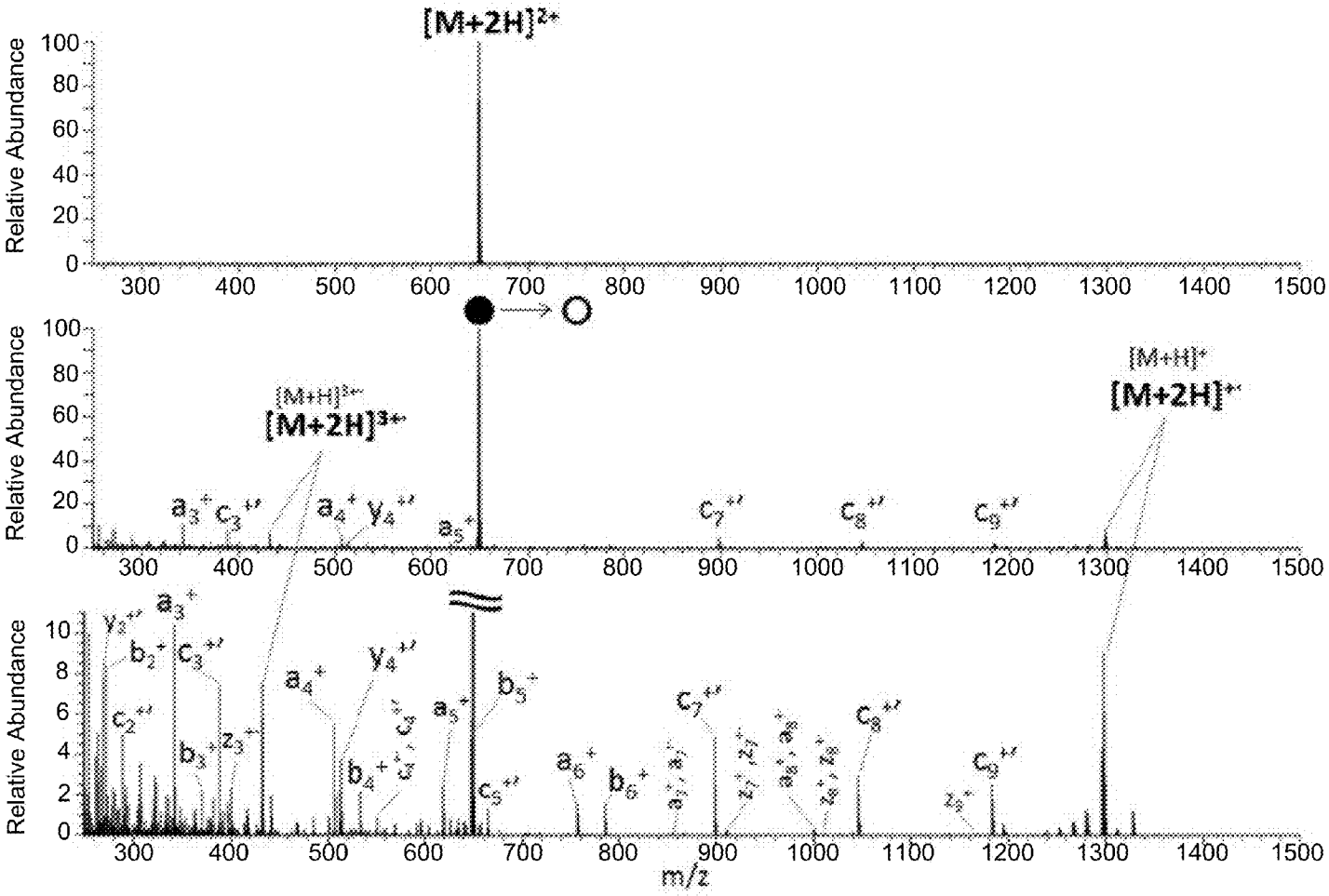
FIGS. 2A and 2B show a tandem MS analysis of doubly-protonated (FIG. 2A) and triply-protonated (FIG. 2B) angiotensin cations activated with a high-energy plasma beam.
Figure 2B:
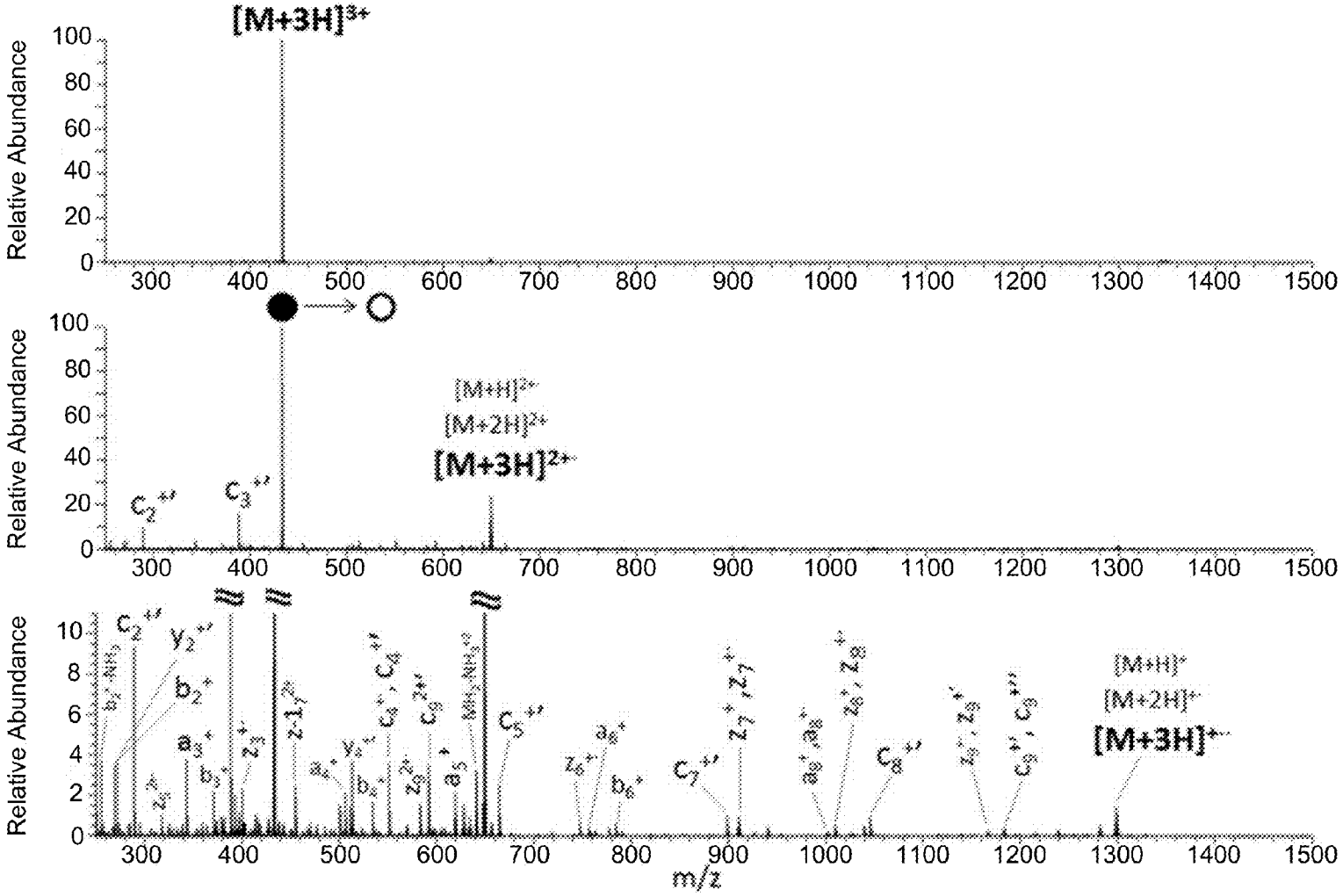

Referring next to FIGS. 2A and 2B, these show a tandem MS analysis of angiotensin cations activated with a high-energy plasma beam. These drawings summarize the results of tandem MS analyses for ESI-produced angiotensin I cations activated with high-energy plasma beam.

In both drawings, the top part shows an MS of isolated precursor species without activation, the middle part shows a tandem MS of an isolated charge state activated by ion plasma for 5 seconds and the bottom part shows an expanded portion of the tandem MS spectrum (9-times magnification).

Doubly-charged (FIG. 2A) and triply-charged (FIG. 2B) precursor species are selected by the quadrupole mass filter 50 and subjected to plasma irradiation over the time interval of 5 seconds. While the efficiency of ion transformation into fragments and other products is relatively low (10%) under the experimental conditions employed, abundant MS/MS pattern can still be revealed upon zooming the generated mass spectra. Some signals are observed as doublets or triplets due to the presence of homologous species that only differ by the number of hydrogen atoms. This difference originates from simultaneous reactions that involve H. transfer (−H. or +H.) and those in which H. transfer does not occur. If one particular isotopic cluster within a multiplet is considerably more abundant than the others, it is highlighted in the spectrum with larger font or bold type (e.g., c4.+ or c4'+).

Interaction of angiotensin cations by the plasma beam fragments all the three bond types of polypeptide backbone: C—CO, C—N and N—Cα. The cleavage of C—N bonds solely proceeds via intramolecular H. transfer from N- to C-terminus, giving rise to y' and b fragments. This fragmentation scenario is common in tandem MS analyses based on vibrational heating such as CAD/CID, infra-red multiple-photon dissociation (IRMPD) and Blackbody Irradiation (BIRD). Conversely, the dissociation of N—Ca bonds proceeds via homolytic as well as heterolytic channels, manifested by c./c'/c" and z/z./z' fragment ion series. Dissociation via the cleavage of N—Cα bonds is highly characteristic for ion activation by electron transfer, for instance in ECD and ETD analyses. The cleavage of C—CO bond is only reflected by a series of a/a. ions, while the complementary x ions are not revealed. Besides backbone cleavages, notable amounts of non-dissociated precursor angiotensin species are observed with reduced charge, formed via electron or proton transfer between the colliding partners without dissociation or with hydrogen atom desorption. Dissociation-free electron attachment appears to be the dominant charge-reduction mechanism based on the much higher abundance of the reduced species having the same mass as the precursor ions (highlighted with bold type in FIGS. 2A and 2B). Finally, an isotopic pattern was detected corresponding to precursor angiotensin ions in the charge state increased from 2+ to 3+. Based on the nearly unchanged mass, the charge state increase predominantly occurs via electron detachment, which is the reverse of electron attachment.

Figure 3A:
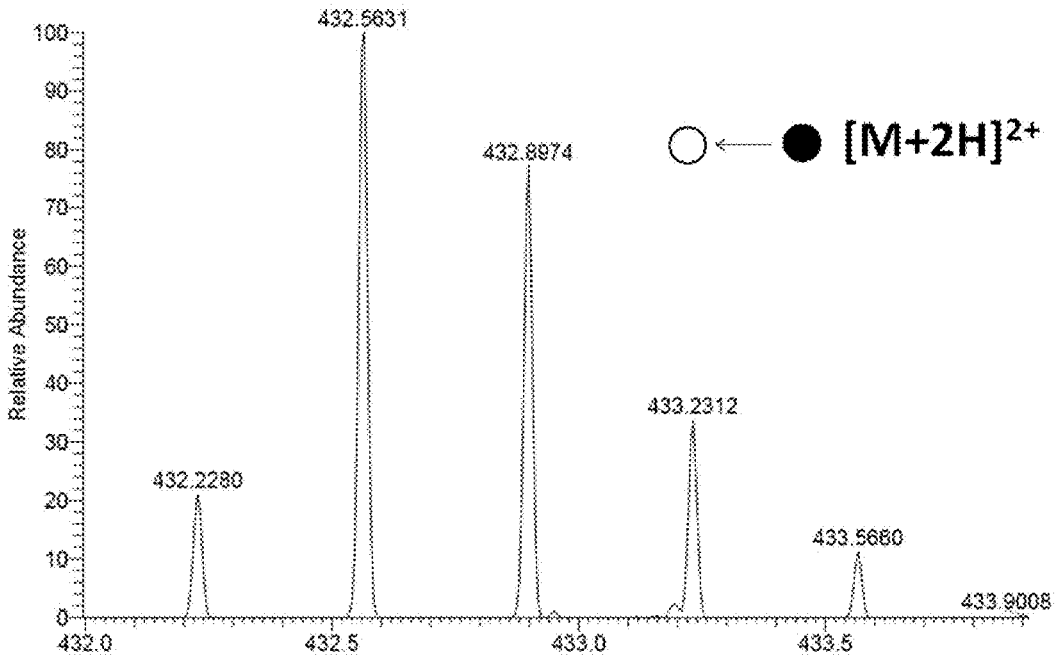
FIG. 3A shows isotopic pattern of triply-charged angiotensin species formed by plasma irradiation of doubly-charged precursors.

Referring next to FIG. 3A, this shows isotopic pattern of triply-charged angiotensin species formed by plasma irradiation of doubly-charged precursors, $[M+2H]^{2+}$. Moreover, referring to FIG. 3B, this shows a deconvoluted isotopic pattern of the product ions revealing the notable contribution of $[M+H]^{3+}$ and $[M+2H]^{3+}$ species. Deconvolution is done based on natural isotopic abundance of angiotensin I. Judging from a somewhat broader than normal isotopic cluster, a mechanism based on H. transfer seems also to be involved. No charge-increased species are observed for triply-charged precursor ions, which is likely due to the higher electron affinity of 3+ charge state compared to 2+ and the lower expected stability of the formed 4+ ions.

Figure 4:
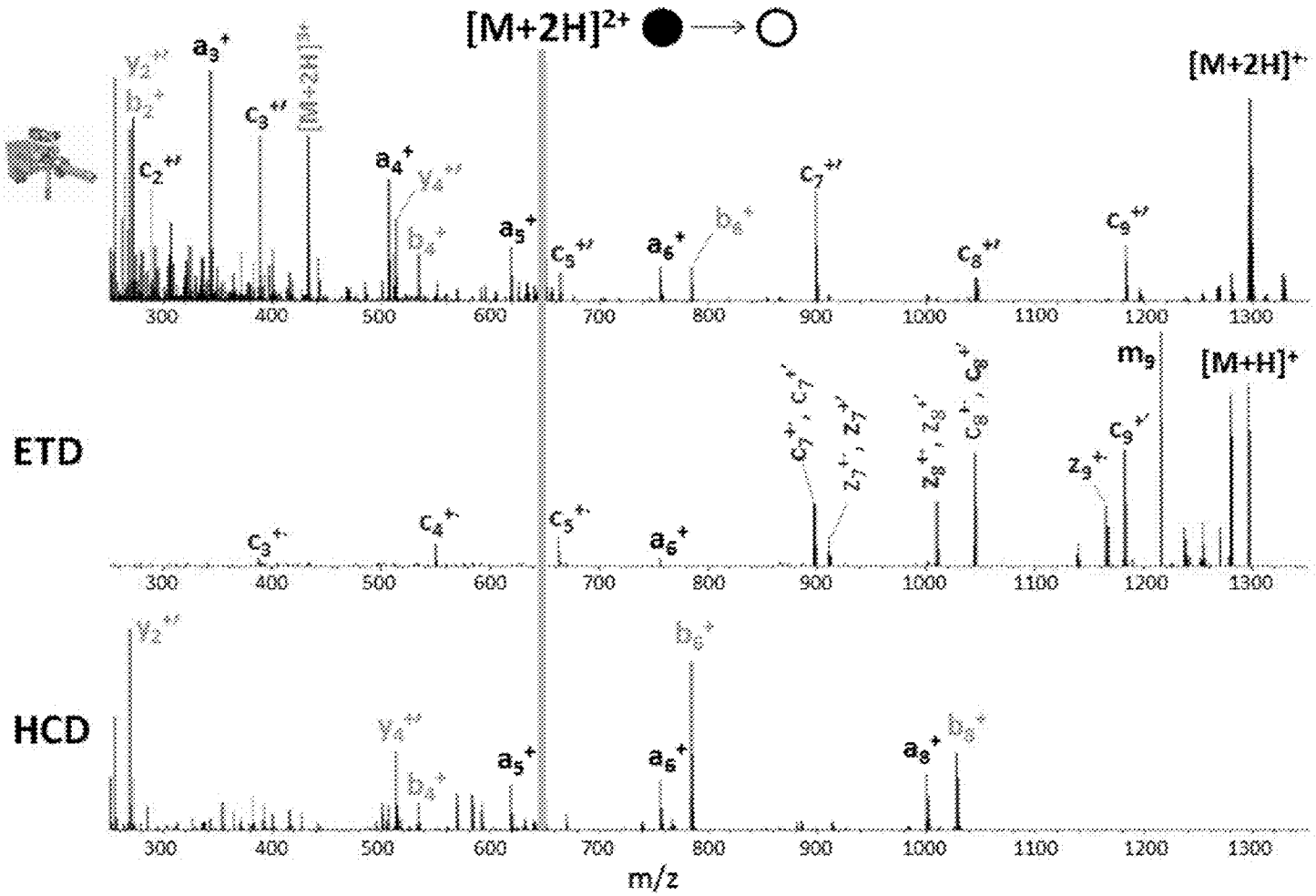
FIG. 4 shows a tandem MS analysis of doubly-charged angiotensin cations using different activation methods: air plasma; ETD; and HCD.

Referring now to FIG. 4, there is shown a tandem MS analysis of doubly-charged angiotensin cations using different activation methods: air plasma; ETD; and HCD. The simultaneous observation of b/y and c/z ion series in the tandem MS analyses suggests substantial contribution of both vibrational and electronic excitation. In order to evaluate the role of these mechanisms and compare the obtained results with conventional MS/MS spectra, reference HCD and ETD experiments on 2+ angiotensin cations are conducted, with the results are summarized in FIG. 4.

ETD spectrum of angiotensin cations is dominated by c/z-fragments with only minor contribution from a-fragments and no notable b/y fragmentation. In general, b/y ions are much more rare in ETD than in ECD, due to the lower recombination energy. Furthermore, due to the relatively high pressure in the HCD cell, ion thermalization there is fast, and the ionic internal temperature rapidly returns to ambient after electron transfer. This is an additional factor that minimizes the internal energy excess after electron transfer and reduces the vibrational heating. Another signature feature of ETD is the presence of a "parasitic" channel involving proton transfer from the polypeptide cation to the anion and resulting in non-dissociative charge neutralization ([M+H]+ signal in FIG. 4). Also typical for nontryptic polypeptides is the prevalence of c- over z-ions with the intensity ratio close to 3:2, which is consistent with these observations.

Almost entirely orthogonal to ETD, HCD activation results in a dominant b/y series of product ions accompanied by a-ions. No c/z fragments were observed for 2+ angiotensin cations, even though the overall efficiency of HCD for target species in low charge states usually greatly exceeds that in both ECD and ETD. The lack of N—Ca bond cleavage is common for CAD/CID methods in the eV range of collisional energies, because the "hot spots" caused by single collisions are rapidly equilibrated via Internal Vibrational energy Redistribution (IVR). As a result, dissociation of polypeptide backbone preferentially occurs across weaker C—N and C—CO backbone bonds.

The overall conclusion may be that the MS/MS spectrum of angiotensin cations produced by air plasma activation combines feature patterns of both HCD and ETD. Observation of b/y series is indicative of "slow" vibrational heating, which can also result from the relaxation of electronic excitation. This mechanism is quite probable in these experiments given the high kinetic energy of reagent cations (1-2 keV). In MS/MS approaches based on electron transfer, secondary fragmentation processes become notable at the reagent kinetic energies of as low as ca. 10 eV, such as in hot ECD (HELD). Alternatively, vibrational heating of angiotensin cations could be induced by neutral species in the plasma beam which lost their charge in collisions with the background gas molecules. These species can serve as an efficient source of collisional activation for angiotensin ions because they preserve the high kinetic energy accumulated during plasma extraction (1-2 keV). The abundant presence of c/z fragments together with non-dissociated charge-reduced species strongly suggests the occurrence of electron transfer from plasma species to angiotensin cations.

It is worth noting that the collision cross-section of polypeptide cations with air cations should be significantly lower than with slow electrons, which is why much higher beam currents are needed compared to ECD in order to achieve notable fragmentation. The ion current of the extracted beam in the experiments is around 100-200 μA, which exceeds typical electron currents in ECD by more than six orders of magnitude. It is also worth mentioning that, since low-mass air plasma cations (for example, those of oxygen and nitrogen) were not trapped by the RF applied to the HCD cell, the ion beam was significantly attenuated when it reached the trapped precursor ions. Such divergence could be reduced by using a magnetic field and tighter focusing of RF and DC fields. It is also preferable that low-mass cut-off in the collision cell is lower than the m/z of the plasma ions.

Different intensity ratios between the c- and t-ions in the MS/MS spectra produced by plasma activation and ETD may point at a significant role of secondary fragmentation processes due to the high excess energy supplied by plasma cations. For example, the relative abundance of c/z ions observed in ECD experiments is dramatically different from the ratio of c/z ions obtained via vibrational heating of charge-reduced precursor species. Unlike ETD experiments, in which charge reduction of angiotensin is accompanied by H. loss, charge reduction by air plasma majorly proceeds without H. transfer. Suppressed efficiency of charge-reduction channel involving H. transfer can be explained by the extremely low proton affinity of plasma cations.

Perhaps the most peculiar feature of the MS/MS spectrum produced by plasma irradiation is the presence of charge-increased precursor cations, which are totally absent in both ETD and HCD spectra. As discussed above, the charge increase, similar to the charge reduction, dominantly proceeds via direct electron transfer (e.g., from O2.+ or N2.+). Simultaneous observation of b/y and c/z fragmentation together with the charge increased precursor ions distinguishes the described method from other fragmentation approaches, e.g. CAD, ETD, MIDI and similar.

In general, less abundant fragmentation patterns are observed, when the polarity of the ion extraction lens installed in front of the HCD cell 30 was reversed from −2 kV to +2 kV. This observation suggests the dominant role of plasma ions over neutrals in activating precursor species in the experiments. Reversing the polarity of the extraction lens also resulted in weaker MS signal from background metal ions that desorbed from electrode surfaces and created strong peaks in the low m/z region.

Figure 3B:
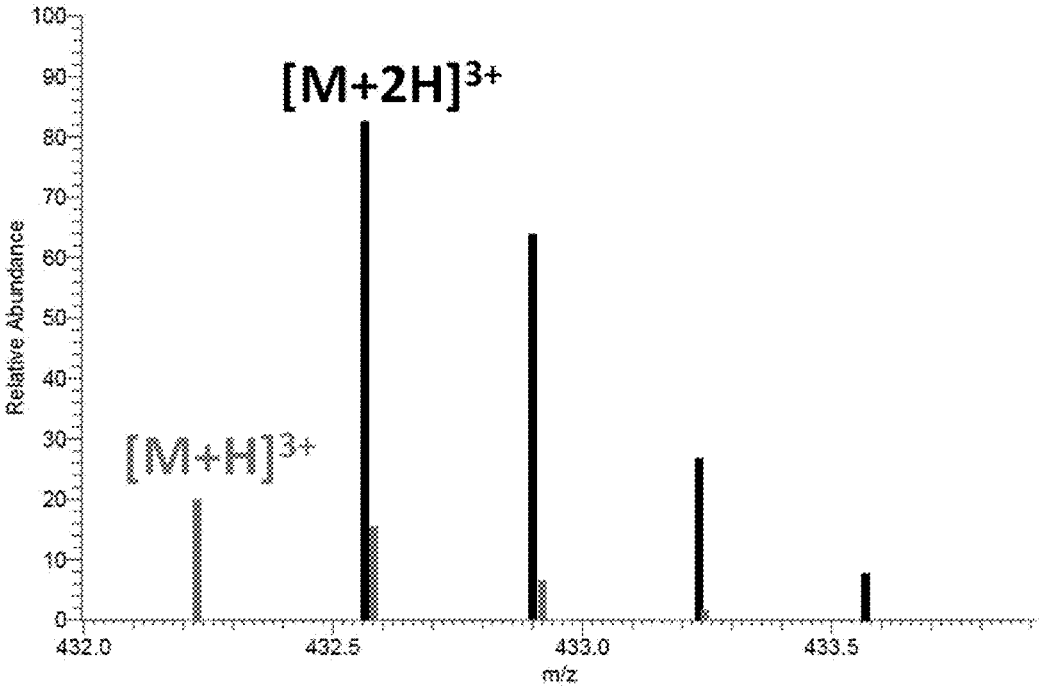
FIG. 3B shows deconvoluted isotopic pattern of the product ions revealing the notable contribution of species formed by the loss of hydrogen atom.

The possibility to integrate characteristics of ETD and HCD in a single technique may be beneficial for polypeptide sequencing. Access to additional dissociation channels enables enhanced backbone cleavage. Although the fragmentation becomes less specific in respect to the type of fragmented bonds, such a fragmentation pattern can exhibit higher sequence specificity. To test this suggestion, 55 most intense peaks present in the three tandem MS analyses of angiotensin I presented in FIGS. 3A and 3B are submitted to online Mascot search against SwissProt proteome database. The reported ions score of the target compound is 23 for ion plasma activation, while it is 20 for HCD and only 12 for ETD. The higher score of the plasma dataset reflects the enhanced bond cleavage, which is particularly important in distinguishing species with minor structural differences, for instance isoforms of peptides with various PTMs, as well as in de novo sequencing.

The capability to increase the charge state of analyte species prior to dissociation is considered a significant potential benefit. "Supercharging" of analytes can be employed as a pre-step in ECD and ETD analyses, which commonly suffer from the low efficiency at low charge states of precursor ions. At the same time, the lower the charge state of precursor species, the higher is their amenability to charge increase, due to the higher proton affinity of the lower charge states. This trend is observed in the experiments for 2+ and 3+ angiotensin I precursor species (FIGS. 2A and 2B). Thus, if the charge-increase process can be made controllable and efficient, a two-step fragmentation process could be developed that will be particularly useful in shotgun bottom-up proteomics, where analyte peptides are mostly doubly charged.

Figure 5:
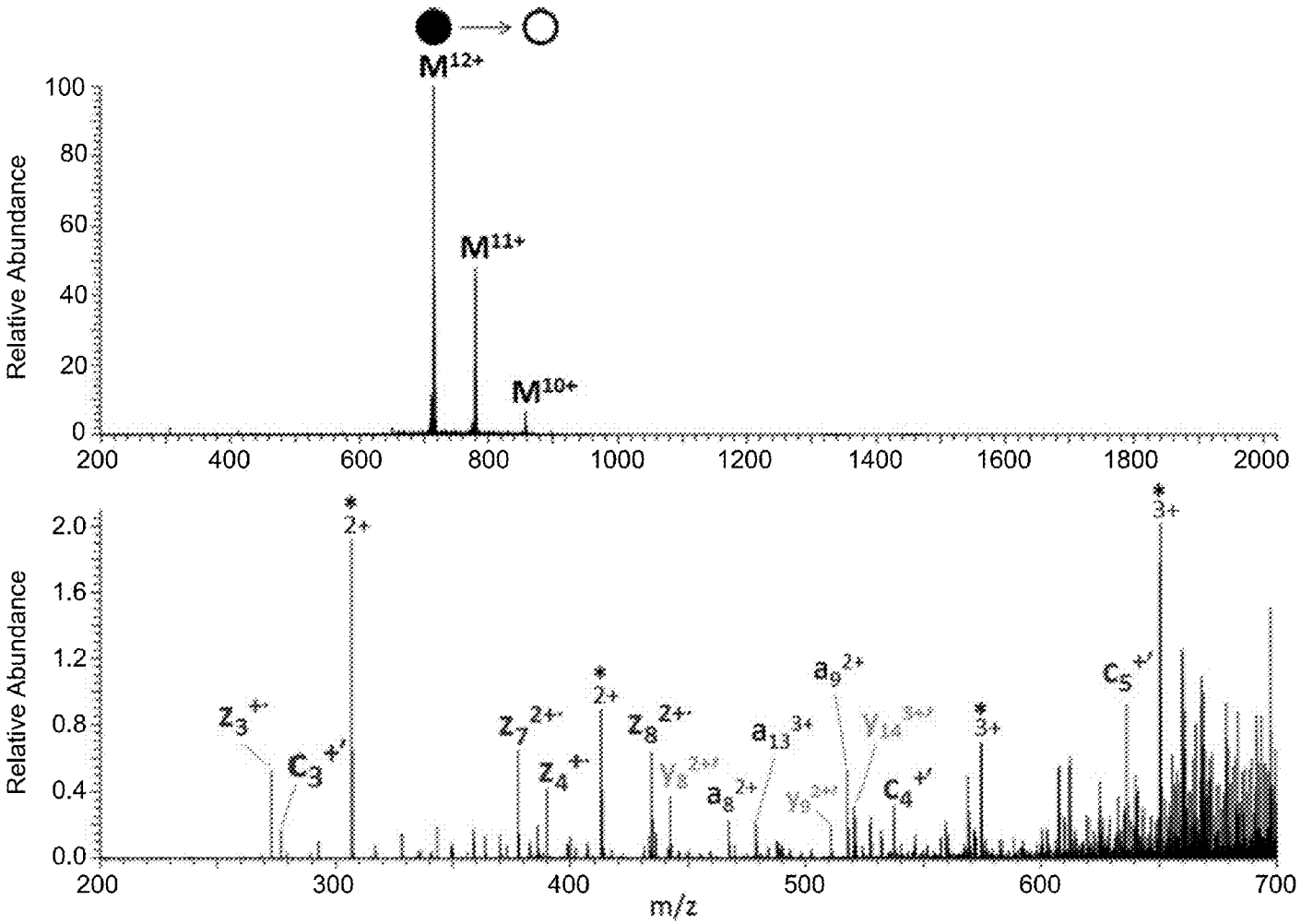
FIG. 5 shows a tandem MS analysis of ubiquitin using activation of precursor ions with air plasma.

With reference to FIG. 5, there is shown a tandem MS analysis of ubiquitin using activation of precursor ions with air plasma. The top part shows a m/z range of 200-2000 and the bottom shows a m/z range of 200-700 (with 50-times magnification). The highest-intensity non-identified signals are labelled with an asterisk.

When air plasma irradiation is applied to activate ubiquitin ions, charge reduction of precursor species becomes a dominant reaction channel, as can be seen in FIG. 5. In ESI-MS, protein ions acquire large number of positive charges and therefore possess much higher electron affinity compared to air cations. This makes the reverse process of electron detachment leading to charge increase less probable for proteins than for peptides. Still, the equilibrium between charge reduction and charge increase mechanisms is expected to shift towards the latter, if the reagent gas used possesses high electron affinity, such as methane. Similar to angiotensin I, air plasma irradiation of ubiquitin cations generated both CAD and ECD types of fragments, although with lower intensity (FIG. 5, bottom).

The prevalence of ECD-like fragments over CAD-like cleavages can be explained by a high threshold of heat-induced dissociation for proteins due to the large number of vibrational modes. Unlike in CAD, the efficiency of nonergodic ECD should be much less dependent on the size of the precursor ions. A number of peaks in MS/MS of ubiquitin cannot be identified using a ProteinProspector search (marked with asterisk) and can possibly be attributed to gas-phase adducts with air components and species sputtered from the electrodes of the HCD cell.

When the polarity of the precursors was switched to negative, adduct formation became the most pronounced reaction channel observed. The only product species for angiotensin I anions activated with air plasma were found to be the adducts of parent ions with an oxygen atom (data not shown).

Thus, irradiation of multiply-protonated biological ions with high-energy cations induces a plethora of gas-phase reactions, including different types of fragmentation, charge reduction, adduct formation as well as charge increase. When applied to polypeptides, air-plasma activation results in a fragmentation pattern that combines characteristics of CAD and ECD and has characteristics of a "two-in-one" tandem MS tool for deeper sequence coverage. Besides that, the plasma irradiation approach allows "supercharging" of biomolecular ions in vacuum without dissociation, which is a much desired feature to increase the efficiency of ECD and ETD MS/MS. By tailoring the composition of reagent gases and plasma energy, it is believed that different reactions can be promoted or suppressed in a controlled fashion. Of particular interest is the ability to manipulate the equilibrium between charge-increase and charge-reduction channels.

Although a specific embodiment of the invention has now been described, the skilled person will understand that various variations and modifications are possible. In particular, the invention can be implemented as part of a wide range of different type of mass spectrometer design. The configuration of devices within the mass spectrometer may be varied. Additionally or alternatively, a range of different types of ion source, ion filters, ion guides, ion storage devices and mass analysers can be used together with the collision cell described herein.

The invention claimed is:

1. A collision cell arranged to receive and trap ions for fragmentation in a chamber and comprising an activation ion generator configured to irradiate the received and trapped ions with activation ions of the same polarity as the received and trapped ions, wherein the activation ion generator is a plasma generator, configured to generate a plasma comprising the activation ions having an energy when they irradiate the received ions of between 700 eV and 2 keV.

2. The collision cell of claim 1, wherein the activation ion generator is configured to irradiate the trapped ions with a charged gas comprising the activation ions of the same polarity as the received ions.

3. The collision cell of claim 1, wherein the plasma generator comprises a plasma chamber, arranged to receive a gas and to generate the plasma comprising the activation ions using the received gas.

4. The collision cell of claim 3, wherein the plasma generator further comprises a microwave energy generator configured to irradiate gas received in the plasma chamber and generate the plasma thereby.

5. The collision cell of claim 3, further comprising an excitation field generator arranged to excite the plasma generated within the plasma chamber and increase plasma density thereby.

6. The collision cell of claim 5, wherein the excitation field generator comprises a magnetic field generator, configured to impose the effect of a cyclotron resonance on the generated plasma.

7. The collision cell of claim 3, wherein the plasma generator further comprises extraction ion optics configured to transfer the activation ions from the plasma chamber towards the collision cell chamber.

8. The collision cell of claim 7, wherein the extraction ion optics comprises:

a first grid electrode;

a second grid electrode, spaced apart from the first grid electrode; and a power supply arrangement configured to provide a first potential to the first grid electrode and a second potential to the second grid electrode, the first and second potentials being of opposite polarity.

9. The collision cell of claim 1, further comprising:

an interface between the activation ion generator and the collision cell chamber; and a pumping arrangement configured to provide a vacuum in the interface.

10. The collision cell of claim 9, wherein the interface further comprises an ion optics lens, configured to facilitate transfer of the activation ions from the activation ion generator to the collision cell chamber.

11. The collision cell of claim 1, further comprising trapping electrodes configured to provide a trapping field for confinement of the received ions to the chamber.

12. The collision cell of claim 11, wherein the trapping electrodes are configured to receive one or more DC potentials in order to generate the trapping field.

13. The collision cell of claim 12, further comprising a controller, configured to control the DC potential applied to the trapping electrodes such that:

a first set of DC potentials is applied to the trapping electrodes during a first time period, in order to cause ions for fragmentation to enter the collision cell chamber; and a second set of DC potentials is applied to the trapping electrodes during a second time period, subsequent to the first time period, the first and second potentials having opposite polarities.

14. The collision cell of claim 13, wherein the controller is further configured to control the DC potential applied to the trapping electrodes such that a third set of DC potentials is applied to the trapping electrodes during a third time period, in order to cause fragmented ions to exit the collision cell chamber.

15. The collision cell of claim 14, wherein the first set of DC potentials is set such that ions enter the collision cell chamber in a first direction and wherein the third set of DC potentials is set such that ions exit the collision cell chamber in a second direction, opposite to the first direction.

16. The collision cell of claim 1, wherein the chamber comprises an ion receiving aperture, configured to allow entrance of ions into the chamber for fragmentation.

17. The collision cell of claim 16, wherein the ion receiving aperture is also configured to allow exit of fragment ions from the chamber.

18. The collision cell of claim 1, wherein the energy of the activation ions when they irradiate the trapped ions is between 1 keV and 2 keV.

19. The collision cell of claim 1, wherein the energy of the activation ions when they irradiate the trapped ions is between 700 eV and 1500 eV.

20. The method of claim 1, wherein the charge of the trapped ions increases when irradiated by the activation ions.

21. A mass spectrometer, comprising:

an ion source for generating ions;

a collision cell, arranged to receive and trap generated ions and to fragment the trapped ions, the collision cell comprising an activation ion generator configured to irradiate the trapped ions with activation ions of the same polarity as the trapped ions, wherein the activation ion generator is a plasma generator, configured to generate a plasma comprising the activation ions having an energy of between 700 eV and 2 keV when they irradiate the trapped ions; and a mass analyser, configured to receive fragment ions for analysis.

22. The mass spectrometer of claim 21, wherein the energy of the activation ions when they irradiate the trapped ions is between 1 keV and 2 keV.

23. The mass spectrometer of claim 21, wherein the energy of the activation ions when they irradiate the trapped ions is between 700 eV and 1500 eV.

24. The method of claim 21, wherein the charge of the trapped ions increases when irradiated by the activation ions.

25. A method of ion fragmentation, comprising:

receiving and trapping ions for fragmentation in a collision cell chamber; and receiving a gas in a plasma chamber of a plasma generator;

generating the plasma comprising the activation ions from the gas in the plasma chamber;

irradiating the trapped ions with activation ions of the same polarity as the trapped ions, wherein the energy of the activation ions when they irradiate the trapped ions is between 700 eV and 2 keV.

26. The method of claim 25, wherein the step of generating further comprises generating the plasma comprising the activation ions by irradiating the gas received in the plasma chamber with microwave energy.

27. The method of claim 25, wherein the step of irradiating further comprises exciting the plasma generated within the plasma chamber, in order to increase plasma density thereby.

28. The method of claim 27, wherein the step of exciting comprises imposing the effect of a cyclotron resonance on the generated plasma using a magnetic field.

29. The method of claim 25, wherein the step of irradiating further comprises transferring the activation ions from the plasma chamber towards the collision cell chamber using extraction ion optics.

30. The method of claim 29, wherein the step of transferring comprises:

providing a first potential to a first grid electrode of the extraction ion optics;

providing a second potential to a second grid electrode of the extraction ion optics, spaced apart from the first grid electrode; and wherein the first and second potentials are of opposite polarity.

31. The method of claim 25, wherein the step of irradiating comprises:

transferring the activation ions from an activation ion generator to the collision cell chamber via an interface; and providing a vacuum in the interface.

32. The method of claim 31, wherein the step of irradiating further comprises facilitating transfer of the activation ions from the activation ion generator to the collision cell chamber using an ion optics lens.

33. The method of claim 25, further comprising:

providing a trapping field for confinement of the received ions to the chamber.

34. The method of claim 33, wherein the step of providing a trapping field comprises applying one or more DC potentials to trapping electrodes.

35. The method of claim 34, wherein the step of applying one or more DC potentials to the trapping electrodes comprises:

applying a first set of DC potentials to the trapping electrodes during a first time period, in order to cause ions for fragmentation to enter the collision cell chamber; and applying a second set of DC potentials to the trapping electrodes during a second time period, subsequent to the first time period, the first and second potentials having opposite polarities.

36. The method of claim 35, wherein the step of applying one or more DC potentials to the trapping electrodes further comprises applying a third set of DC potentials to the trapping electrodes during a third time period, in order to cause fragmented ions to exit the collision cell chamber.

37. The method of claim 36, wherein the first set of DC potentials is set such that ions enter the collision cell chamber in a first direction and wherein the third set of DC potentials is set such that ions exit the collision cell chamber in a second direction, opposite to the first direction.

38. The method of claim 25, wherein the step of receiving and trapping ions for fragmentation comprises receiving the ions into the collision cell chamber via an ion receiving aperture.

39. The method of claim 38, further comprising:

ejecting fragment ions from the collision cell via the ion receiving aperture.

40. The method of claim 25, wherein the energy of the activation ions when they irradiate the trapped ions is between 1 keV and 2 keV.

41. The method of claim 25, wherein the energy of the activation ions when they irradiate the trapped ions is between 700 eV and 1500 eV.

42. The method of claim 25, wherein the charge of the trapped ions increases when irradiated by the activation ions.

* * * * *